US007896714B2

(12) United States Patent
Moist

(10) Patent No.: US 7,896,714 B2
(45) Date of Patent: Mar. 1, 2011

(54) SUBMERSIBLE ELECTRICAL SET-SCREW CONNECTOR

(75) Inventor: Stanford C. Moist, Amherst, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 12/476,768

(22) Filed: Jun. 2, 2009

(65) Prior Publication Data

US 2009/0311897 A1 Dec. 17, 2009

Related U.S. Application Data

(60) Provisional application No. 61/131,877, filed on Jun. 13, 2008.

(51) Int. Cl.
*H01R 11/03* (2006.01)

(52) U.S. Cl. ..... 439/793; 439/271

(58) Field of Classification Search ..... 439/271, 439/521, 523, 796–798, 921, 793
See application file for complete search history.

(56) References Cited

U.S. PATENT DOCUMENTS

| | | | | |
|---|---|---|---|---|
| 3,827,704 | A * | 8/1974 | Gillemot et al. | 277/209 |
| 4,090,029 | A * | 5/1978 | Lundeberg | 174/51 |
| 4,259,542 | A * | 3/1981 | Tehan et al. | 174/48 |
| 4,283,597 | A * | 8/1981 | Cooper, Jr. | 174/138 |
| 4,460,227 | A * | 7/1984 | Ball | 339/94 |
| 4,648,672 | A * | 3/1987 | Kobler | 339/94 |
| 5,056,196 | A * | 10/1991 | van Walraven | 24/279 |
| 5,230,537 | A * | 7/1993 | Newman | 285/112 |
| 5,295,851 | A * | 3/1994 | Bawa et al. | 439/273 |
| 6,764,354 | B2 * | 7/2004 | Kaine et al. | 439/793 |
| 6,817,910 | B2 * | 11/2004 | Borgstrom et al. | 439/798 |
| 6,997,759 | B1 * | 2/2006 | Zahnen et al. | 439/798 |
| 7,090,532 | B1 * | 8/2006 | Kaine | 439/523 |
| 7,183,486 | B2 * | 2/2007 | Pyron et al. | 174/59 |
| 7,549,898 | B2 * | 6/2009 | Waltz | 439/796 |
| 2006/0155280 | A1 * | 7/2006 | Siebens et al. | 606/61 |
| 2008/0268721 | A1 * | 10/2008 | Waltz | 439/793 |

OTHER PUBLICATIONS

"Mole Coupler and Mole Sleeve", Burndy® Underground Products for Network and Residential Distribution Catalog, Apr. 2008, p. 35.*

* cited by examiner

*Primary Examiner*—Thanh-Tam T Le
(74) *Attorney, Agent, or Firm*—Harrington & Smith

(57) ABSTRACT

Disclosed herein is a submersible electrical set-screw connector. The submersible electrical set-screw connector includes a connector body section and a first sealing member. The connector body section includes a first opening and a second opening. The first opening is substantially perpendicular to the second opening. The first opening is adapted to receive a portion of an electrical conductor. The first sealing member is removably connected to the submersible electrical set-screw connector. The sealing member is adapted to receive the electrical conductor. The sealing member includes an outer cylindrical surface and an inner cylindrical surface. The outer cylindrical surface includes a first centerline axis. The inner cylindrical surface includes a second centerline axis. The first centerline axis is offset from the second centerline axis.

9 Claims, 5 Drawing Sheets

SUBMERSIBLE ELECTRICAL SET-SCREW CONNECTOR

CROSS REFERENCE TO RELATED APPLICATION

This application claims priority under 35 U.S.C. §119(e) to U.S. provisional patent application No. 61/131,877 filed Jun. 13, 2008 which is hereby incorporated by reference in its entirety.

BACKGROUND

1. Field of the Invention

The invention relates to an electrical connector and, more particularly, to a submersible electrical set-screw connector.

2. Brief Description of Prior Developments

Submersible electrical set-screw connectors for making connections in power distribution networks are known in the art. U.S. Pat. No. 6,764,354 B2, which is hereby incorporated by reference in its entirety, discloses a submersible electrical set-screw connector. A similar insulated water-tight connector assembly including a set screw driver and plug is disclosed in U.S. Patent Publication No. 2006/0155280 A1 which is hereby incorporated by reference in its entirety. These conventional connectors provide set-screw assemblies having various configurations.

SUMMARY

The foregoing and other problems are overcome, and other advantages are realized, by the use of the exemplary embodiments of this invention.

In accordance with one aspect of the invention, a submersible electrical set-screw connector is disclosed. The submersible electrical set-screw connector includes a connector body section and a first sealing member. The connector body section includes a first opening and a second opening. The first opening is substantially perpendicular to the second opening. The first opening is adapted to receive a portion of an electrical conductor. The first sealing member is removably connected to the submersible electrical set-screw connector. The sealing member is adapted to receive the electrical conductor. The sealing member includes an outer cylindrical surface and an inner cylindrical surface. The outer cylindrical surface includes a first centerline axis. The inner cylindrical surface includes a second centerline axis. The first centerline axis is offset from the second centerline axis.

In accordance with another aspect of the invention, an electrical connector sealing member is disclosed. The electrical connector sealing member includes a main section having an outer diameter and an inner diameter. The main section is adapted to be disposed between a portion of an electrical connector and an electrical conductor. The main section includes a first wall thickness between the outer diameter and the inner diameter. The sealing member includes a second different wall thickness between the outer diameter and the inner diameter. The second wall thickness is more than two times larger than the first wall thickness.

In accordance with another aspect of the invention, a method of manufacturing an electrical connector sealing member is disclosed. A main section having an outer surface is provided. The outer surface includes a first diameter. The main section is adapted to be received by an electrical connector at the outer surface. An inner surface extending through the main section is provided. The inner surface includes a second diameter. The inner surface is adapted to receive an electrical conductor. A centerline axis of the inner surface is spaced from a centerline axis of the outer surface. The first diameter is approximately double the second diameter.

BRIEF DESCRIPTION OF THE DRAWINGS

The foregoing aspects and other features of the invention are explained in the following description, taken in connection with the accompanying drawings, wherein.

DETAILED DESCRIPTION

Figure 1:
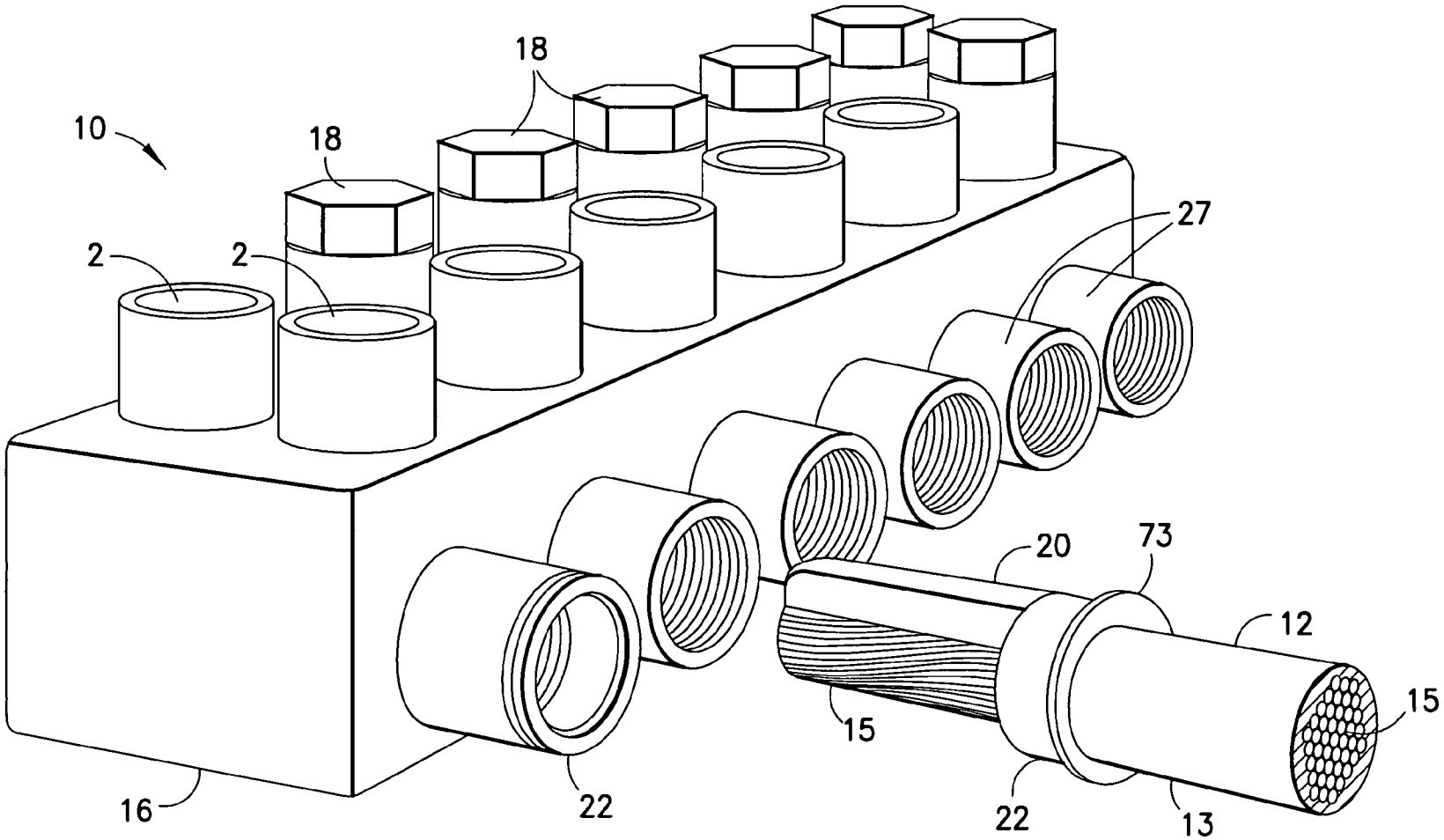
FIG. 1 is a perspective view of a submersible electrical set-screw connector comprising features of the invention.

Referring to FIG. 1, there is shown a perspective view of a submersible electrical set-screw connector 10 incorporating features of the invention, intended to be used to connect multiple electrical conductors 12 (only one of which is shown) to each other. Although the invention will be described with reference to the exemplary embodiments shown in the drawings, it should be understood that the invention can be embodied in many alternate forms of embodiments. In addition, any suitable size, shape or type of elements or materials could be used.

Figure 2:
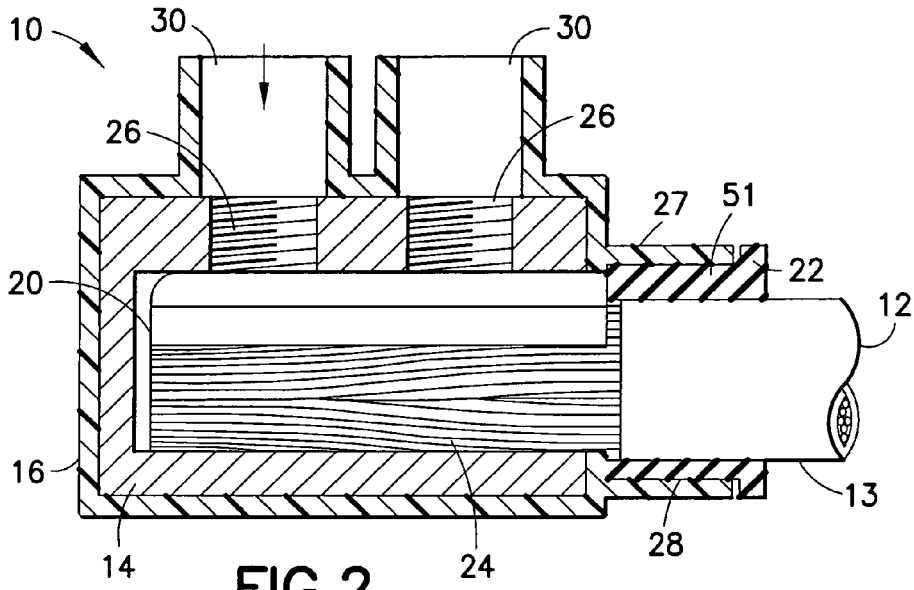
FIG. 2 is a cross section view of the submersible electrical set-screw connector shown in FIG. 1.
Figure 3:
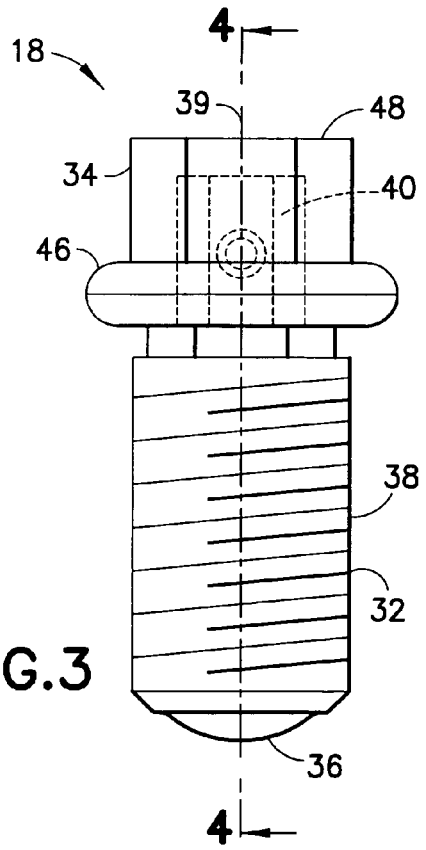
FIG. 3 is a front view of a set-screw assembly used in the submersible electrical set-screw connector shown in FIG. 1.
Figure 4:
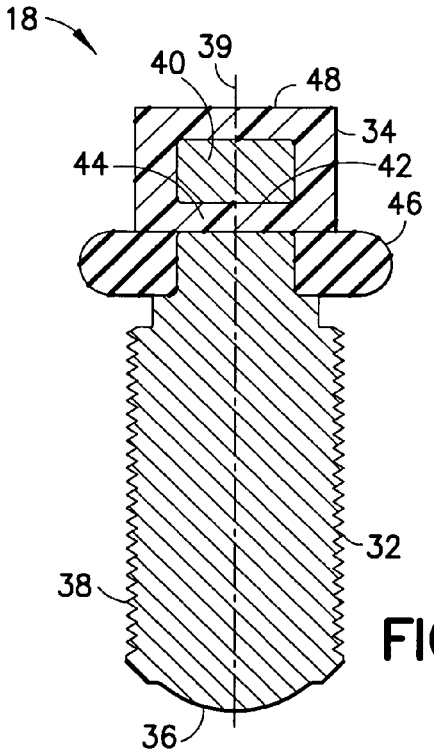
FIG. 4 is a cross section view of the set-screw assembly shown in FIG. 3.
Figure 5:
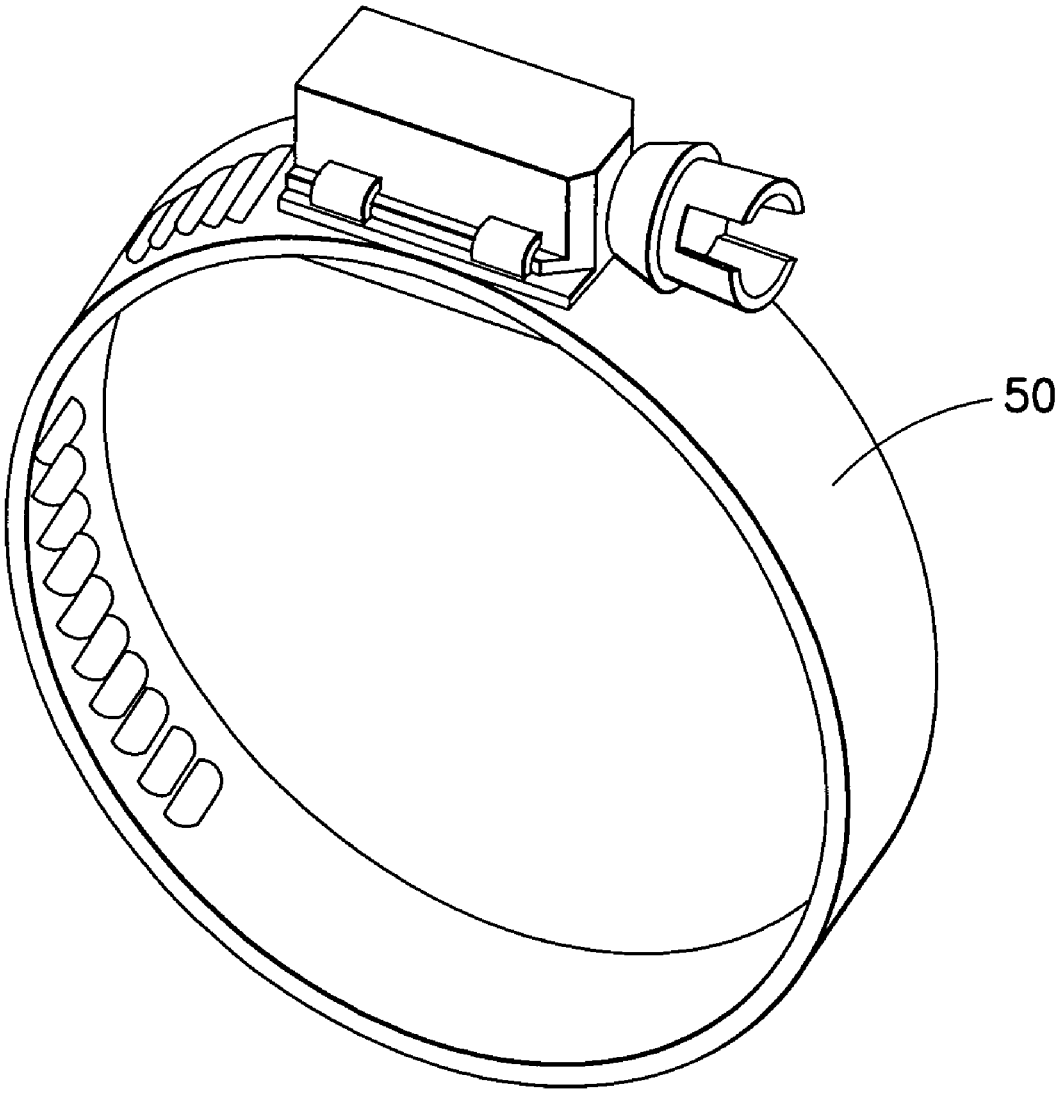
FIG. 5 is a perspective view of a clamp for use with the connector shown in FIG. 1.

Referring also to FIGS. 2-4, the connector 10 generally comprises a body 14, a cover 16, set screw assemblies 18, adapters 20, and sealing members 22. In an alternate embodiment the adapters 20 might not be provided. The connector might also include sealing plugs (not shown) to cover unused holes in the cover 16. The body, or connector body section, 14 is comprised of electrically conductive material, such as aluminum for example. The body 14 has holes (or openings) 24 for receiving the electrically conductive cores 15 of the conductors 12. The body 14 also has holes (or openings) 26 for receiving the set screw assemblies 18. The holes 24 are substantially perpendicular to the holes 26. However, alternate embodiments may comprise any suitable configuration. The cover 16 is preferably overmolded onto the body 14. The cover is comprised of an electrically insulating material such as a polymer material. The cover 16 has tubes 27 with holes (or openings) 28 for receiving ends of the conductors 12 and the sealing members 22. The sealing members 22 may be removably connected to the connector 10 at the holes 28. Referring also to FIG. 5, each tube 27 preferably has a clamp 50 on it to clamp the tube 27 and the sealing member 22 onto the outer diameter of the conductor 12. The cover 16 also has holes (or openings) 30 for receiving the set screw assemblies 18. The holes 28 are substantially perpendicular to the holes 30. However, alternate embodiments may comprise any suitable configuration.

Each of the set screw assemblies 18 generally comprise a screw body 32 and a screw head 34. Similar set screw assemblies are described in U.S. patent application Ser. No. 12/103,200 filed Apr. 15, 2008 which is hereby incorporated by reference in its entirety. The screw body, or body part, 32 is preferably comprised of metal and comprises a first end 36 for contacting the conductor 12 or the adapter 20, a threaded shaft (or threaded section) 38 and a second end 40. The second end 40 has a general hexagon shape with a channel 42 therein. The channel 42 extends in a direction substantially transverse to a central axis 39 of the threaded section 38.

The screw head 34 is preferably comprised of an electrically insulating material, such as a molded plastic or polymer material. The screw head 34 is preferably overmolded onto the second end 40 of the screw body 32. During overmolding, material forming the screw head 34 extends into the channel 42 to form locking section 44 and surrounds a portion of an outer surface of the second end 40. This interlocks the screw head 34 onto the screw body 32 as a non-removable connection forms the screw body 32 and the screw head 34 into a one-piece member. In an alternate embodiment the connection might be removable, such as if the screw head is connected to the screw body after the screw head is formed.

The screw head, or head part, 34 generally comprises the locking section 44 located in the channel 42 and a top hexagon section 48. A separate or integrally formed sealing ring section 46 is provided. The locking section 44 is integrally formed with the screw head 34 during the overmolding. The top hexagon section 48 is aligned with the hexagon shape of the second end 40 of the screw body 32 such that the material of the screw head 34 at the top hexagon section 48 has a substantially uniform thickness. During overmolding, the screw body 32 is precisely located in one of six positions in the molding device to align the hexagon shapes. The uniform thickness of the material at the top hexagon section 48 provides the benefit of better strength of the section 48 and helps to prevent cracks from developing. The hexagon shape is provided for a hexagon shaped tool or a wrench to screw the set screw assembly 18 into the body 14 and cover 16. In alternate embodiments, other shapes could be provided.

When the set screw assembly 18 is inserted into one of the holes 30, 26, the threaded shaft 38 can thread into the threaded hole 26. The sealing ring section 46 can make a sealing engagement with the cover 16 at the hole 30.

While the submersible electrical set-screw connector 10 has been described in connection with the set screw assembly 18, one skilled in the art will appreciate that the invention is not necessarily so limited and that any suitable set screw assembly may be provided.

Figure 6C:
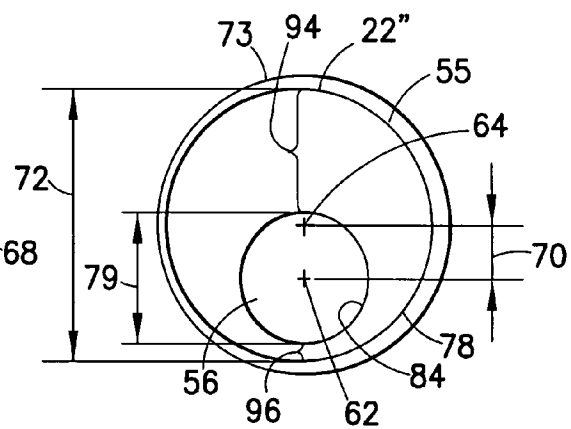
FIGS. 6A-6C are end views of sealing members for use with the connector shown in FIG. 1.

Referring now also to FIG. 6, in a preferred embodiment of the invention the cover 16 can be used with multiple different types of the sealing members. FIG. 6 shows three types of the sealing members 22, 22', 22" which can be sold individually or as part of a kit with the connector 10. More or less than three types of sealing members could be provided. The sealing members 22, 22', 22" may comprise a main sections 51, 53, 55 having a same outer shape with a same constant outer diameter 72 which is sized and shaped to fit inside one of the holes 28. The outer shape may be a cylindrical shape forming an outer cylindrical surface, wherein the sealing members 22, 22', 22", are received by the holes 28 at the outer cylindrical surface. A flange (or flange section) 73 may also be provided on the sealing members 22, 22', 22".

According to one embodiment of the invention, the sealing members may be one piece members formed from a resilient material such as an elastomer or polymer material, for example. However, in alternate embodiments, any suitable type of material may be provided.

Figure 7:
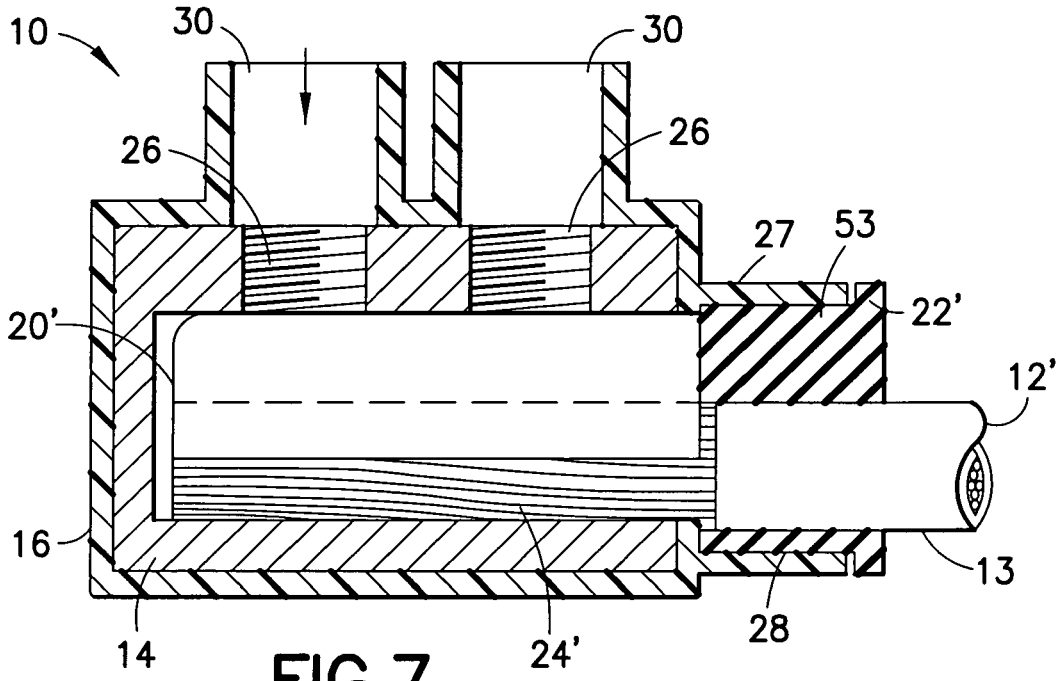
FIG. 7 is a cross sectional view of the connector shown in FIG. 1, similar to FIG. 2, but showing connection of a different size conductor to the connector.
Figure 8:
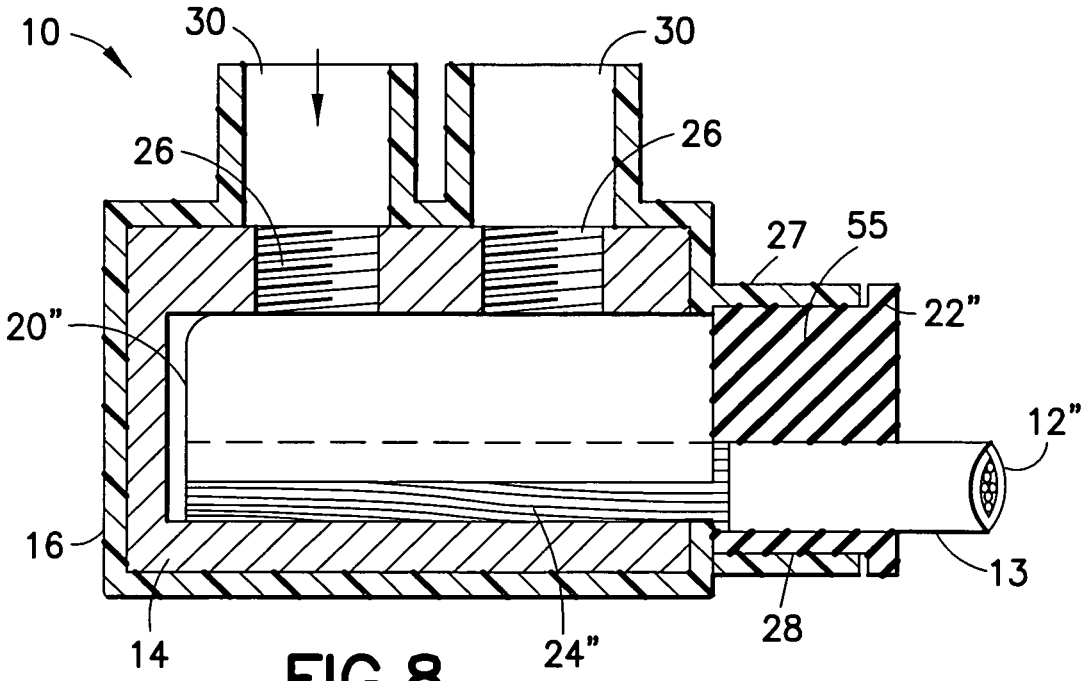
FIG. 8 is a cross sectional view of the connector shown in FIG. 1, similar to FIGS. 2 and 7, but showing connection of another different size conductor to the connector.

The sealing members 22, 22', 22" have different size inner diameter holes 52, 54, 56. The inner diameter holes 52, 54, 56, provide a cylindrical shape forming an inner cylindrical surface extending through the main section 51, 53, 55. The different size holes 52, 54, 56 allow use of the connector 10 with different size conductors 12, 12', 12" (wherein the main section 51, 53, 55 receives the conductors 12, 12', 12" at the inner cylindrical surface) as shown in FIGS. 2, 7 and 8. In this embodiment the holes 52, 54, 56 each have a centerline axis 58, 60, 62 which are offset (or radially spaced) from the center axis 64 of the respective sealing member 22, 22', 22" by respectively different offsets 66, 68, 70. However, in an alternate embodiment at least one of the sealing members could have the centerline axis of its conductor receiving hole aligned with its center axis.

Any suitable outer diameter and inner diameter may be provided for the sealing members. For example, in FIGS. 2 and 6A, the outer diameter 72 (of the outer cylindrical surface 74) may be about forty percent larger than an inner diameter 75 of the hole 52 (and the inner cylindrical surface 80). Additionally, due to the offset configuration of the outer and inner diameters, various different wall thicknesses 86, 88 may be provided between the inner surface 80 and the outer surface 74. For example, the wall thickness 86 may be about two times larger (or thicker) than the wall thickness 88. However, any suitable wall thickness configuration may be provided.

Figure 6B:
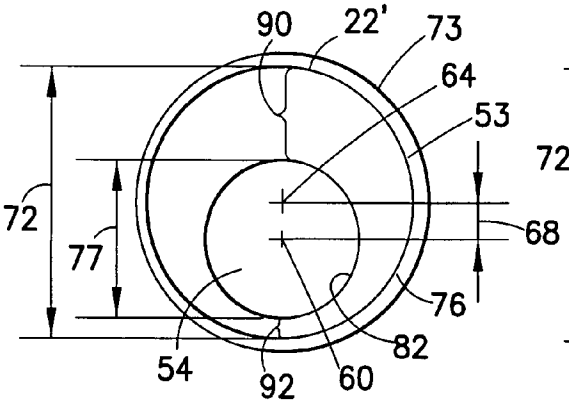
Figure 6A:
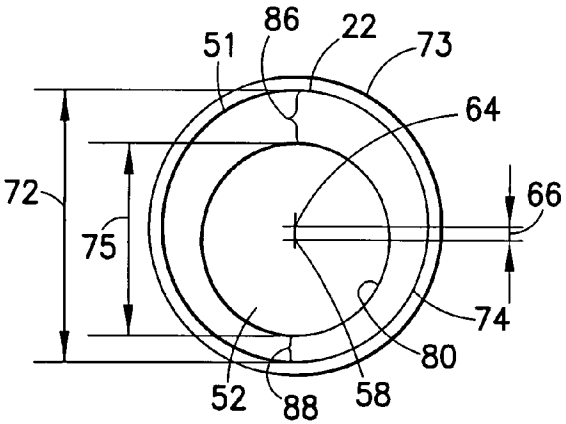

For example, in FIGS. 7 and 6B, the outer diameter 72 (of the outer cylindrical surface 76) may be about seventy five percent larger than an inner diameter 77 of the hole 54 (and the inner cylindrical surface 82). Additionally, due to the offset configuration of the outer and inner diameters, various different wall thicknesses 90, 92 may be provided between the inner surface 82 and the outer surface 76. For example, the wall thickness 90 may be about three times larger (or thicker) than the wall thickness 92. However, any suitable wall thickness configuration may be provided.

For example, in FIGS. 8 and 6C, the outer diameter 72 (of the outer cylindrical surface 78) may be about double (or two times larger than) an inner diameter 79 of the hole 56 (and the inner cylindrical surface 84). Additionally, due to the offset configuration of the outer and inner diameters, various different wall thicknesses 94, 96 may be provided between the inner surface 84 and the outer surface 78. For example, the wall thickness 94 may be about five times larger (or thicker) than the wall thickness 96. However, any suitable wall thickness configuration may be provided.

According to one embodiment, the wall thicknesses 88, 92, 96 may be substantially the same thickness. However, any suitable configuration may be provided.

The connector 10 can preferably be placed on the ground with the conductors 12, 12', 12" also lying on the ground as they enter the connector 10. The offset nature of the holes 52, 54, 56 allow the holes to be located close to the bottom of the connector for the purpose of allowing the conductors 12, 12', 12" to lay close to the ground as they enter the connector 10.

As seen in FIGS. 2, 7 and 8, the connector 10 can also comprise different size adapters 20, 20', 20" for the different size conductors 12, 12', 12". However, in alternate embodiments more or less than three size adapters could be provided, or the connector might not have any adapters, such as if the set screw assemblies 18 are long enough for example.

When the clamps 50 are tightened around the outer perimeter of respective ones of the tubes 27, the tubes 27 compress the sealing members 20, 22', 22" onto the outer insulation 13 of the conductors 12, 12', 12" to form a watertight seal with the conductors in the holes 28. The sealing members 22, 22', 22" form removable bushings which can be provided as a kit for the installer/user to configure as he/she sees fit in view of the sizes of the conductors being connected together by the connector 10.

According to another example of the invention, a method of manufacturing an electrical connector sealing member is disclosed. The method includes the following steps. Providing a main section having an outer surface, wherein the outer surface comprises a first diameter, wherein the main section is adapted to be received by an electrical connector at the outer surface. Providing an inner surface extending through the main section, wherein inner surface comprises a second diameter, wherein the inner surface is adapted to receive an electrical conductor, wherein a centerline axis of the inner surface is spaced from a centerline axis of the outer surface, and wherein the first diameter is approximately double the second diameter. It should be noted that any of the above steps may be performed alone or in combination with one or more of the steps.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A submersible electrical set-screw connector comprising:

a connector body section comprising a first opening and a second opening, wherein the first opening is substantially perpendicular to the second opening, and wherein the first opening is adapted to receive a portion of an electrical conductor;

a first sealing member removably connected to the submersible electrical set-screw connector, wherein the first sealing member is adapted to receive the electrical conductor, wherein the sealing member comprises an outer cylindrical surface and an inner cylindrical surface, wherein the outer cylindrical surface comprises a first centerline axis, wherein the inner cylindrical surface comprises a second centerline axis, and wherein the first centerline axis is offset from the second centerline axis;

a set screw assembly adapted to be received by the second opening, wherein the set screw assembly comprises a screw body and a screw head, and a second sealing member removably connected to the connector, wherein the second sealing member comprises an outer surface and an inner surface, wherein the outer surface comprises a first diameter, wherein the inner surface comprises a second diameter, wherein the first diameter is at least fifty percent larger than the second diameter, wherein the second sealing member is adapted to receive another differently sized electrical conductor, wherein the second diameter is offset from the first diameter, wherein the inner cylindrical surface of the first sealing member forms a first hole extending through the first sealing member, wherein the second diameter of the second sealing member forms a second hole extending through the second sealing member, and wherein a diameter of the first hole is greater than a diameter of the second hole.

2. A submersible electrical set-screw connector as in claim 1 wherein the outer cylindrical surface comprises a first diameter, wherein the inner cylindrical surface comprises a second diameter, and wherein the first diameter is approximately double the second diameter.

3. A submersible electrical set-screw connector as in claim 1 wherein the first sealing member comprises a first wall thickness between the outer cylindrical surface and the inner cylindrical surface, wherein the first sealing member comprises a second different wall thickness between the outer cylindrical surface and the inner cylindrical surface, and wherein the second wall thickness is more than two times larger than the first wall thickness.

4. A submersible electrical set-screw connector as in claim 1 further comprising a cover and a clamp, wherein the cover is over the body section, wherein the clamp is adapted to be mounted on to a portion of the cover, and wherein the clamp is adapted to compress the first sealing member on to the electrical conductor.

5. A submersible electrical set-screw connector as in claim 1 wherein the first sealing member further comprises a flange section.

6. A submersible electrical set-screw connector as in claim 1 wherein the first sealing member comprises a one piece member formed from an elastomer material.

7. A submersible electrical set-screw connector comprising:

a connector body section comprising a first opening and a second opening, wherein the first opening is substantially perpendicular to the second opening, and wherein the first opening is adapted to receive a portion of an electrical conductor;

a first sealing member removably connected to the submersible electrical set-screw connector, wherein the first sealing member is adapted to receive the electrical conductor, wherein the first sealing member comprises an outer cylindrical surface and an inner cylindrical surface, wherein the outer cylindrical surface comprises a first centerline axis, wherein the inner cylindrical surface comprises a second centerline axis, and wherein the first centerline axis is offset from the second centerline axis;

a set screw assembly adapted to be received by the second opening, wherein the set screw assembly comprises a screw body and a screw head, wherein the outer cylindrical surface comprises a first diameter, wherein the inner cylindrical surface comprises a second diameter, wherein the first diameter is approximately double the second diameter, wherein the first sealing member comprises a first wall thickness between the outer cylindrical surface and the inner cylindrical surface, wherein the first sealing member comprises a second different wall thickness between the outer cylindrical surface and the inner cylindrical surface, and wherein the second wall thickness is more than two times larger than the first wall thickness;

a second sealing member removably connected to the connector, wherein the second sealing member comprises an outer surface and an inner surface, wherein the outer surface comprises a first diameter, wherein the inner surface comprises a second diameter, and wherein the first diameter is at least fifty percent larger than the second diameter, wherein the second sealing member is adapted to receive another differently sized electrical conductor, wherein the second diameter is offset from the first diameter, wherein the inner cylindrical surface of the first sealing member forms a first hole extending through the first sealing member, wherein the second diameter of the second sealing member forms a second hole extending through the second sealing member, and wherein a diameter of the first hole is greater than a diameter of the second hole.

8. A submersible electrical set-screw connector as in claim 7 further comprising a clamp, wherein the clamp is adapted to compress the first sealing member or the second sealing member on to the electrical conductor.

9. A submersible electrical set-screw connector as in claim 7 wherein the first diameter of the first sealing member is substantially equal to the first diameter of the second sealing member.

* * * * *